US005280915A

United States Patent [19]

Groussman

[11] Patent Number: 5,280,915

[45] Date of Patent: Jan. 25, 1994

[54] METHOD OF PLAYING DOUBLE ACTION BLACKJACK

[76] Inventor: Raymond K. Groussman, 276-204 N. El Camino Real, Oceanside, Calif. 92054

[21] Appl. No.: 994,507

[22] Filed: Dec. 21, 1992

[51] Int. Cl.[5] ..... A63F 1/00
[52] U.S. Cl. ..... 273/292; 273/309
[58] Field of Search ..... 273/274, 292, 309

[56] References Cited

U.S. PATENT DOCUMENTS

| | | | |
|---|---|---|---|
| D. 263,975 | 4/1982 | Quiroga et al. | 273/274 |
| 4,651,997 | 3/1987 | Wood | 273/274 |
| 4,659,087 | 4/1987 | Shen et al. | 273/274 |
| 5,141,234 | 8/1992 | Boylan et al. | 273/274 |
| 5,154,429 | 10/1992 | LeVasseur | 273/274 |
| 5,167,413 | 12/1992 | Fulton | 273/274 |

OTHER PUBLICATIONS

Scarne's Encyclopedia of Games by John Scarne, Harper & Row Publishers, pp. 276–282, 1973.

*Primary Examiner*—Benjamin H. Layno

[57] ABSTRACT

A method of playing a blackjack game that will enable a blackjack player to make the second initial 21 wager and play the second initial hand on any deal of the cards. The layout of the table includes boxes on each player station where the wagers are placed, and card dealing areas next to each of the boxes where the hands of cards are dealt. The boxes and card dealing areas are spaced sufficiently far enough apart so that players are not deprived a place to place a "21" wager and play at the table. Furthermore, with this layout the dealer and player can clearly determine which cards belongs to the player's first wager and which cards belong to the player's second wager.

1 Claim, 3 Drawing Sheets

METHOD OF PLAYING DOUBLE ACTION BLACKJACK

FIELD OF INVENTION

This invention relates to the game of Blackjack.

BACKGROUND OF THE INVENTION

Blackjack, also called "Twenty-One", is played in most casinos throughout the world. The conventional (gaming establishment) Blackjack table is a half-circle with one curved side for the players to stand or sit and a straight side where the dealer stands or sits. The conventional Blackjack table provides one station with a single "21" wager box for each player. Blackjack tables are designed to accommodate one player at each station. Most Blackjack tables have five, six or seven stations. It is to the advantage of the gaming establishment to have Blackjack tables that will enable players to make the maximum number of initial "21" wagers possible on each deal without crowding the table.

BLACKJACK HAS ITS OWN LANGUAGE: As used by most Blackjack players and gaming establishment operators and as used in this patent application, the following words have the following meanings ascribed to them:

"Bet"—Wager made by players.

"Blackjack"—the Americanized name of Vingt-et-Un (French for Twenty-one) and/also means a 10 count card plus an Ace, totaling 21 in the player's or the dealer's initial hand.

"Casino"—A gaming establishment.

"Deal"—the distribution of the cards to the players and dealer.

"Dealer"—the person that deals the cards.

"Each Deal" means performing the following things: The dealer dealing two cards to each player's "21" wager or "21" wagers and two cards to the dealer to begin the game. At least one of dealer's cards is turned face-up); each player then takes hits or stands, and/or makes additional bets such as insurance or doubling down or splitting pairs for each of his wager or wagers, as desired by the player; when all of the players have completed their play, the dealer then takes hits or stands as required by the predetermined conventional manner of play of the dealer's hand; when the dealer has completed the play of his hand, winning player's wagers are paid and losing player's wagers are collected and the dealer gathers up all cards from the players' hands and from his hand and put those cards face up under the deck or in the card rack.

"Double Down"—to place a wager adjacent to the "21" wager and the dealer will deal one additional card to that hand.

"Draw"—take additional cards to add to the cards in the player's hand.

"Hand"—the cards dealt in one group to a player's "21" wager and played by the player, and/or dealt in one group to the dealer.

"Initial" means before the start of the deal.

"First Initial Hand" means the first hand dealt to a player's first initial "21" wager.

"Second Initial Hand"—the second hand dealt to a players second initial "21" wager.

"Hit"—to draw additional cards to be added to the cards in the hand.

"Layout"—the design imprinted onto the playing surface of the Blackjack table and/or a fabric table cover that shows the "21" wager boxes, the "Insurance" wager box, and/or other information, such as "Blackjack Pays 2 to 1".

"Player"—the person who makes a wager and plays the cards dealt to that wager.

"Push"—means tie; stand-off; no action.

"Split"—to make two hands out of the original two card pair or equal value cards.

"Stand"—play the cards the player and/or dealer has and not draw any more cards.

"Station"—a designated area on the layout where one player makes his initial wager or wagers and where the dealer deals cards to the player's "21" wager or "21" wagers and the area where that player's winnings are paid.

"Single "21" Wager Box"—A rectangle or other identifiable designated area on the layout where one player may place one initial "21" wager, double down wagers and/or split wagers and where the cards are dealt for that wager.

"Double "21" Wager Box" means two adjacent "21" wager boxes touching one vertical line that extends above the two adjacent wager boxes.

"Wager"—Bet made by a player.

"21" Wager" or "21" Bet"—a "21" wager made by a player in the wager box at that players station. Winning or losing that wager is determined by the conventional method of playing Blackjack.

"Initial Wager"—a wager (bet) made before the start of the deal;

"First Initial "21" Wager"—means the first initial "21" wager made in one of the two wager boxes of the player's double "21" wager box before the start of the deal.

"Second Initial "21" Wager—means the second initial "21" wager made by the player in the other wager box of the double "21" wager box.

"Up-Card"—the dealer's face up card.

METHOD OF PLAYING ON CONVENTIONAL BLACKJACK TABLES

Conventional Blackjack involves a game of chance between a dealer and one or more players. The object for the player is to achieve a count of his hand closer to 21 than the count in the hand of the dealer, but not over 21. If the count of the player's hand goes over 21 the player loses regardless of the final count of the dealer's hand.

The conventional manner of play of Blackjack is as follows: A standard deck of 52 standard poker or bridge playing cards are used. Sometimes multiple decks are used. In most conventional Blackjack games the suits (spades, hearts, diamonds and clubs) have no value or meaning and are disregarded. Only the numerical value of the card is considered. The Tens, Jacks, Queens and Kings have a value of 10. The two through Nine count as the index, or face value, indicates. The Ace may be counted as either a 1 or 11, whichever is the most beneficial to the count of the hand.

At conventional and heretofore modified Blackjack tables, when playing one hand, before the start of each deal, the player makes an initial "21" wager in the "21" wager box at the station he is playing. When a player plays two hands he places an initial wager in each of the "21" wager boxes at two stations.

The dealer starts the deal by dealing two cards to each "21" wager. The dealer also deals two cards to himself. One of the dealer's cards is dealt face-up and the other card face-down. In some gaming establishments, the dealer receives his two cards at the same time that each player is dealt his two cards. In other gaming establishments the dealer initially receives only one card which becomes the dealer's "Up Card". After each player either "stands" or takes additional cards the dealer then deals himself the second card.

A player may draw additional cards (take "hits") in order to try to beat the count of the dealer's hand. If the player's count exceeds 21, the player "busts". The player may "stand" on any count of 21 or less. When a player busts, he/she loses his/her wager regardless of whether or not the dealer busts.

After all of the players have taken "hits" or "stand" on their hand, the dealer "stands" or "hits", based on the table rules for the game. Usually the rules state that if the dealer has less than 17, the dealer must take a hit. If the dealer has 17 or more, the dealer stands. Some table rules require the dealer take a hit whenever the dealer's hand is a "soft" 17 count. The term "soft" means that the Ace is valued as a count of 11, instead of as a count of 1. A soft 17 occurs when the dealer has an Ace and a Six (or multiple cards that add up to 6). The dealer stands on soft 18's, soft 19's and soft 20's.

After the dealer's final hand has been established, the numerical count of the dealer's hand is compared to the numerical count of the player's hand. If the dealer busts, the player wins regardless of the numerical count of his hand, unless the player's hand is over 21. If neither the player nor the dealer have busted, the closest hand to the numerical count of 21, without going over, wins; tie hands are a "push".

One well-known procedure in the game is "Doubling Down". If the player's first two cards have a combined value of 10 or 11, the player may "double down" on his hand. The player turns both of his cards face-up in front of his wager box and makes a second "21" wager equal to the amount of his/her initial "21" wager.

The dealer deals to the player one additional card and the resulting three card hand establishes the total numerical count for the player's hand. The most widely used "Doubling Down" rules permit the player to "double down" only on 10 or 11 counts. Other variations allow players to "double down" on 9, 10, 11; or on any two cards.

Another procedure in the game of Blackjack is "Splitting Pairs". If the player's first two cards are a pair, the player may "split" those cards into two separate hands. His original "21" wager is applied to one of the hands and he makes an additional "21" wager for the other hand. The player receives a new second card for each of the split hands. Each of the split hands is played separately and the player proceeds by standing or taking hits until he/she has achieved a hand count upon which he/she wishes to stand or busts. When splitting Aces the player receives only one additional card for each hand. In most gaming establishments, a player may also split his/her hand if both of his initial cards are ten count cards. For example, a player can split if he receives a Ten and a Queen, or a Jack and a King. A hand with a count of 20 is a good hand and most Blackjack players are reluctant to risk a good hand by "splitting".

Another Blackjack procedure is "Insurance". If the dealer's up card is an Ace, the player may make an "Insurance" bet. The insurance bets are made after each player receives his/her first two cards and the dealer reveals his up card and before any additional cards are dealt. When the dealer's up card is an Ace, each player can wager one-half of the amount of his/her original "21" wager as insurance against the dealer having a Blackjack, i.e. a two-card 21 count. If the dealer has a two-card 21 count, the player loses his original wager but wins two-to-one on his insurance bet. Also if the dealer has a two-card 21 count that round of the game is over and all players lose except those who also have a two-card 21 count who tie or "push" with the dealer. If the dealer does not have a two-card 21 count, the player loses on his "Insurance" bet and the round of the game continues.

SUMMARY OF THE INVENTION

In the method of play in the present invention, a player may make one initial "21" wager and play one initial hand or make two initial "21" wagers and play two initial hands within one station on the Blackjack table against one dealer's hand on each deal of the cards. Specifically the player can make two initial "21" wagers and play two initial hands at one player's station against one dealer hand and not deprive another player a place at the table because the player has made the second initial "21" wager and plays the second initial hand.

OBJECT OF THIS INVENTION

Figure 1:
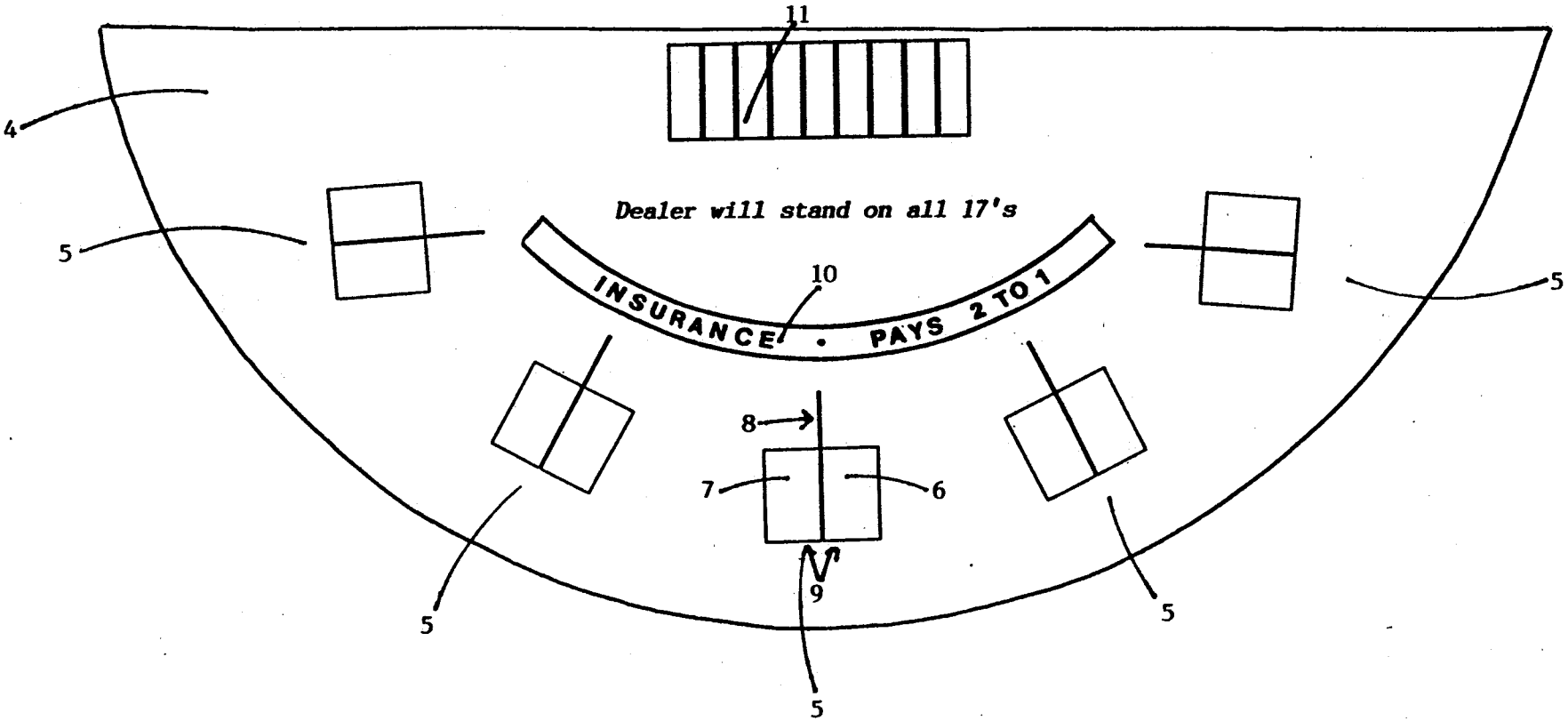
FIG. 1 shows a preferred Blackjack table layout of the present invention.

An object of this invention to to make more stations available at Blackjack tables in gaming establishments. Blackjack is the most popular table casino game in the world. Most gaming establishments have a limited number of Blackjack tables. Often players have to wait for a an open station at the tables.

Another object of this invention is to make the game of Blackjack more interesting. The conventional Blackjack tables and the method of playing on those tables have remained remarkably unchanged over the years. There have been other modifications made to the basic game. Few, if any, of the modifications have found favor with both the players and the gaming establishment operators and/or achieved universal popularity.

Another object of this invention is enable each player to make two initial "21" wagers and play two initial hands on each deal of the cards without depriving another player a place at the table by making the second initial "21" wager and playing the second initial hand on the same deal. Many players prefer to make two initial "21" wagers and play two initial hands on the same deal. At conventional Blackjack tables, some gaming establishments permit players to play two initial hands on the same deal by placing an initial "21" wager in the "21" wager boxes at two stations. Often it deprives another player a station at the table. Some gaming establishments restrict players to playing at only one station when other players are waiting to play.

Another object of this invention is to help avoid disappointing the players. As a means of relaxation many people travel a long distance to play Blackjack in legal gaming establishments. It is often disappointing to many of those people to wait long periods of time for an open station at a Blackjack table because other players at conventional Blackjack tables are taking up two stations by playing two hands.

Another object of this invention is to increase the gaming establishment's profit. The principle disadvantage of conventional and heretofore modified Blackjack tables is when one or more players play two initial hands on the same deal it took up two stations and often depriveed other players a place the table. When three players at a conventional or heretofore modified blackjack table each take two stations by playing two initial hands, a six player table becomes a three player table and a seven player table becomes a four player table. Fewer players at the table usually means less profit at the table per hour for the gaming establishment.

Another object of this invention was to create an improved Blackack game and Blackjack table layout that will have the following advantages over conventional and/or heretofore modified Blackjack table layouts and/or games.

ADVANTAGES OF THIS INVENTION

Each station on layouts of the present invention have two "21 wager boxes instead of one "21" wager box in each station on the conventional Blackjack layouts.

From the perspective of the gaming establishment, the feature of the present invention enable them to increase the total amount wagered each hour at the table by players making two initial "21" wagers and playing two initial hands without depriving another player a place at the table by playing two hands instead of one hand.

The close proximity of a player's second "21" wager box to the player's first "21" wager encourage many players to place two initial "21" wagers and play two hands simultaneously, which frequently increases the gaming establishment's profit.

At Blackjack tables with the present invention each player at a six station table can make two initial "21" wagers and play two initial hands at one station, against one dealer's hand on each deal of the cards. Regardless of the number of players at tables of this invention that play two initial hands, a six station or player table will still remain a six station or player table.

From the perspective of the players, the use of tables with the present invention at gaming establishments will enable players to more readily find open stations at the Blackjack tables; it enables a player to play two initial hands without feeling "guilty" for depriving another player a place at the table; it enables a player to play a greater number of hands per hour and it also makes the game more interesting to most players.

PREFERRED EMBODIMENTS OF THIS INVENTION

U.S. Pat. No. 5,105,184, Noorali Pirani, shows that a new method and/or apparatus may be integrated with a prior method and/or apparatus and still be an original method and/or apparatus.

Figure 2:
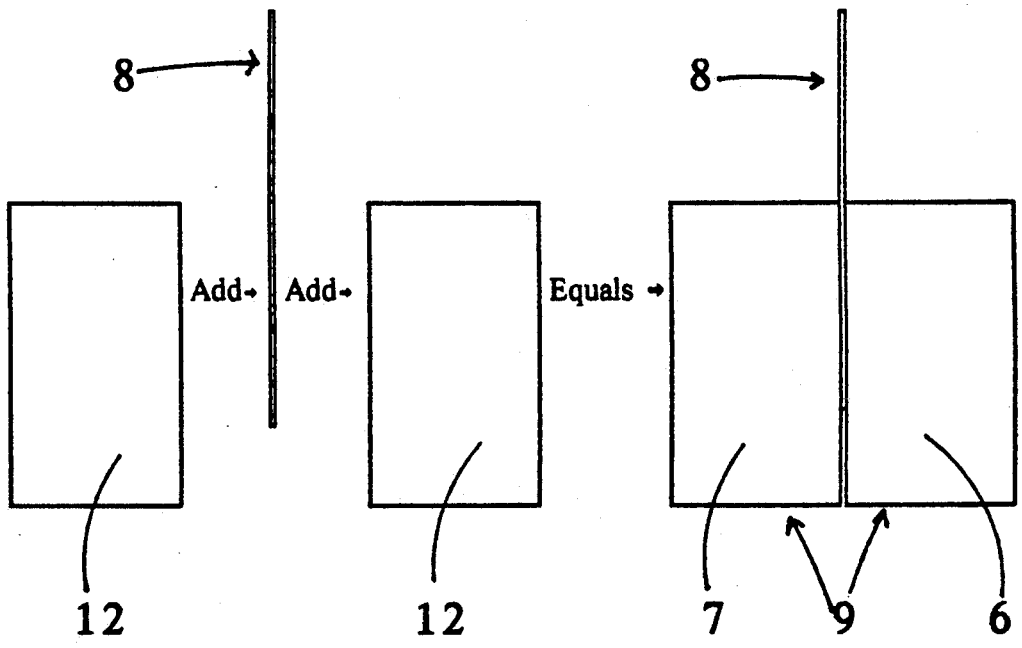
FIG. 2 shows a flow chart illustrating the three parts of a Double "21" Wager Box of the present invention.
Figure 3:
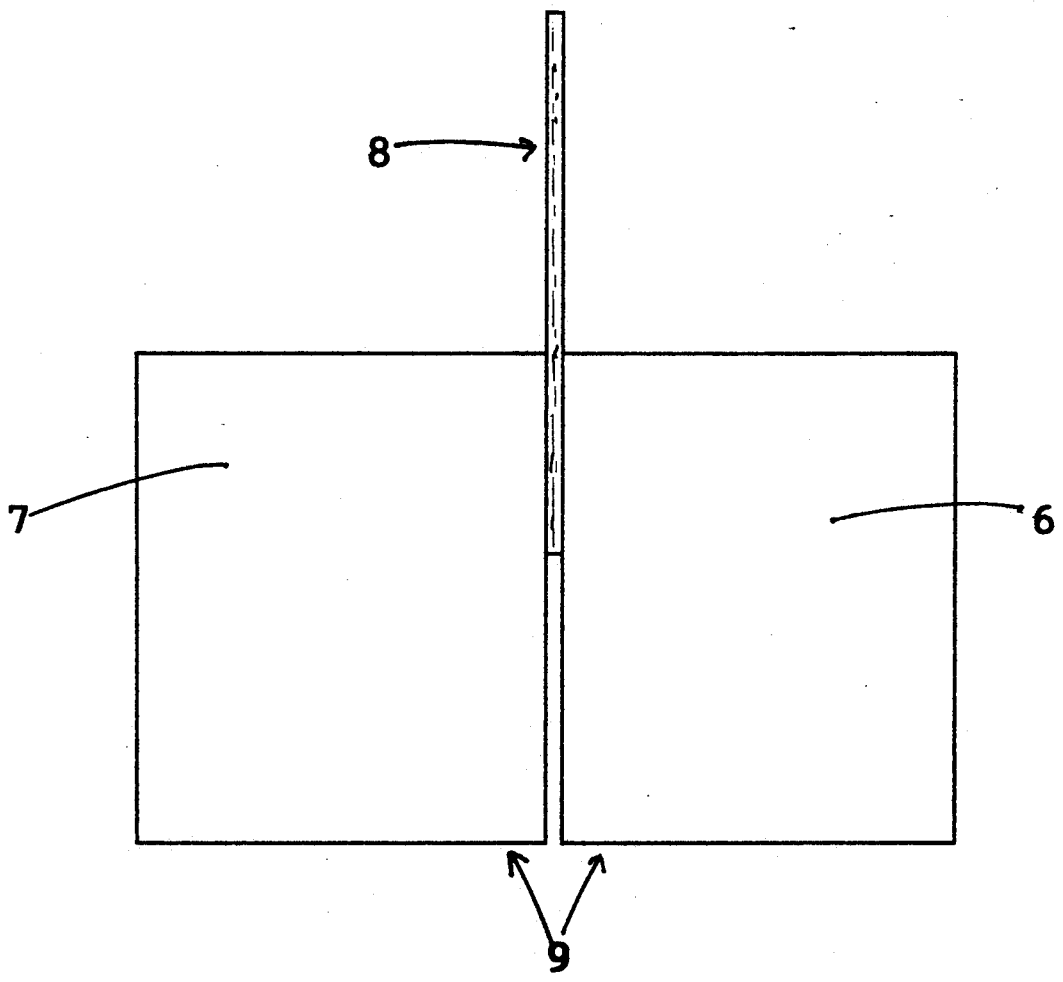
FIG. 3 shows an enlarged view of a Double "21" Wager Box of the present invention.

FIG. 2 shows a flow chart leading to the present invention of a "Double "21" Wager Box" 9. Two individual and separated "21" wager boxes 12 from a conventional Blackjack table have been moved closely adjacent to each other and a vertical line 8 placed between and touching both of the wager boxes 12. The result of integrating two conventional Blackjack "21" wager boxes 12 with a touching vertical line 8 has created an original "Double "21" Wager Box" 9 in one station 5 and enabled this inventor to create a layout apparatus 4 by placing two or more stations 5 onto the layout 4.

The present invention comprises a modified version of a conventional Blackjack table layout.

The layout 4 of this invention has one or more individual player stations 5 with a Double "21" Wager Box 9 that consists of "21" wager box 6, an adjoining "21" wager box 7 and a vertical line 8 positioned between and touching "21" wager box 6 and "21" wager box 7 and extending above two touching "21" wager boxes 6 and 7; an "Insurance" wager box 10; an area in the center of the straight side of the layout 4 for a money and chip tray 11.

A player can at one station 5 make one initial "21" wager in wager box 6 and play one initial hand or also make an additional initial "21" wager in wager box 7 and play two initial hands against the dealer's one hand without depriving another player a station 5 on table layout 4 because the player made his second intitial "21" wager. The "21" wagers may be of equal or of different amounts, within the table limits.

After all players' "21" wagers have been made the game is played as it is played in conventional Blackjack; such as the dealer deals two cards to each wager and himself. The vertical line 8 helps the dealer and the player identify which cards are dealt to "21" wager box 6 and which cards are dealt to wager box 7 when two initial hands are dealt to the double "21" wager box 9. One of the dealer's cards is dealt face-up and the other card face-down. In some gaming establishments, the dealer receives his two cards at the same time that each player is dealt their two cards. In other gaming establishments the dealer initially receives only one card which becomes the dealer's Up card. After each player either "stands" or takes additional cards the dealer then deals himself the second card.

A player may draw additional cards (take hits) in order to try to beat the count of the dealer's hand. If the player's count exceeds "21", the player "busts". The player may "stand" on any count of "21" or less. When a player hand busts, he loses that "21" wager regardless of whether or not the dealer busts.

After all of the players have taken hits or stand on their hand, the dealer stands or hits based on the table rules for the game. Usually the rules state that if the dealer has less than 17, the dealer must take a hit. If the dealer has 17 or more, the dealer stands. Some table rules requires that the dealer take a hit whenever the dealer's hand is a "soft" 17 count. The term "Soft" means that the Ace can be counted as either an one or as an eleven. A soft 17 occurs when the dealer has an Ace and a Six (or multiple cards that add up to 6).

After the dealer's final hand has been established, the numerical count of the dealer's hand is compared to the numerical count of the player's hand(s). If the dealer busts, the player wins regardless of the numerical count of his hand(s), unless the hand is over a count of 21.

Thus, while the present invention has been described with respect to exemplary embodiments thereof of the Double "21" Wager Box 9 and the method of playing on the modified Blackjack layout 4, it will be understood by those of ordinary skill in the art that variations and modifications can be effected within the scope and spirit of this invention, specifically the altering the shape of "21" Wager Boxes 6 and 7 and the Double "21" Wager Box 9 or by removing or moving vertical line 8.

Within "21" wager boxes 6 and 7 there may be provided an indication or indications, such as "1st Hand" and/or "2nd Hand", "1st Bet" and/or "2nd Bet" or other indications.

Based on the information provided in the previous pages,

I claim:

1. A method of playing a modified version of Blackjack using at least one conventional deck of 52 playing cards, and a table layout having a dealer station located on one side of the table and a plurality of player stations along the periphery of a side opposite the side of the dealer station, each player station having a first wager box and a second wager box, and adjacent each first wager box is a first card dealing area, and adjacent each second wager box is a second card dealing area, each card dealing area having sufficient surface area for allowing a hand of cards in Blackjack to be dealt thereon such that two hands of cards are capable of being dealt to each player station, the method comprising the steps of:

(a) assigning each player to a player station and requiring each player to place a first wager on their first wager box in order to receive a first initial hand of cards;

(b) allowing each player to optionally place a second wager on their second wager box before any cards are dealt, in order to receive a second initial hand of cards;

(c) the dealer dealing only one initial hand of two cards to each playing station having only one wager, wherein only one initial hand being dealt to each first card dealing areas of these playing stations;

(d) the dealer dealing two initial hands of two cards to each playing station having two wagers, wherein a first initial hand being dealt to each first card dealing area of these playing stations and a second initial hand being dealt to each second card dealing area of these playing stations;

(e) the dealer dealing an initial dealer's hand of two cards;

(f) each player either electing to stay and have no cards dealt to their initial hand or hands, or electing not to stay and having the dealer deal additional cards to their hand or hands in accordance to the conventional manner of play of Blackjack, wherein the player or players having two hands, treating each hand as a separate hand of cards in Blackjack;

(g) the dealer either staying and having no cards dealt to the initial dealer's hand, or not staying and dealing additional cards to the dealer's hand in accordance to predetermined Blackjack rules set forth by the casino;

(h) the dealer comparing the dealer's hand to the hand of each player that only placed one wager, wherein if a player's hand beats the dealer's hand the dealer paying the player based on the amount of the player's wager, or if the dealer's hand beats the player's hand the dealer collecting the player's wager in accordance with the conventional manner of play of Blackjack;

(i) the dealer comparing the dealer's hand to the hands of each player that placed two wagers, wherein if a player's first hand beats the dealer's hand the dealer paying the player based on the amount of the player's first wager, or if the dealer's hand beats the player's first hand the dealer collecting the player's first wager, and wherein if a player's second hand beats the dealer's hand the dealer paying the player based on the amount of the player's second wager, or if the dealer's hand beats the player's second hand the dealer collecting the player's second wager in accordance with the conventional manner of play of Blackjack.

* * * * *